United States Patent [19]

Johanson et al.

[11] Patent Number: 4,883,115

[45] Date of Patent: Nov. 28, 1989

[54] METHOD AND APPARATUS FOR COOLING HIGH-TEMPERATURE PROCESSES

[75] Inventors: Niles W. Johanson; James C. Saeger, both of San Diego; Mark L. White, San Marcos, all of Calif.

[73] Assignee: Ogden Environmental Services, Inc., San Diego, Calif.

[21] Appl. No.: 245,914

[22] Filed: Sep. 16, 1988

[51] Int. Cl.[4] ..... F28D 19/00

[52] U.S. Cl. ..... 165/1; 165/39; 165/104.13; 165/104.34; 165/911; 110/245; 122/7 R

[58] Field of Search ..... 165/104.13, 104.34, 165/911, 39, 1; 110/245; 122/7 R

[56] References Cited

U.S. PATENT DOCUMENTS

| | | | |
|---|---|---|---|
| 3,725,566 | 4/1973 | Plizak | 165/104.13 |
| 3,982,586 | 9/1976 | Ruble | 165/104.32 |
| 4,269,170 | 5/1981 | Guerra . | |
| 4,490,980 | 1/1985 | Kira et al. | 165/104.13 |
| 4,549,407 | 10/1985 | Gruber . | |

FOREIGN PATENT DOCUMENTS

| | | | |
|---|---|---|---|
| 2453380 | 12/1980 | France | 165/104.34 |
| 843725 | 5/1984 | South Africa . | |

*Primary Examiner*—Albert W. Davis, Jr.
*Attorney, Agent, or Firm*—Fitch, Even, Tabin & Flannery

[57] ABSTRACT

A method and apparatus for controllably removing heat from a high-temperature process wherein finely atomized liquid suspended in a stream of transport gas is used as a coolant pumped through a heat exchanger while remaining separated from the high-temperature process. The system pressure and flow rates are maintained at levels such that the temperature of the coolant exceeds the boiling point of the liquid component at the outlet of the heat exchanger. Means are provided to monitor continuously the temperatures of the process and of the coolant at the outlet of the heat exchanger and adjust the flow rates of the liquid and/or the transport gas as necessary to maintain the respective temperatures within predetermined ranges.

20 Claims, 2 Drawing Sheets

METHOD AND APPARATUS FOR COOLING HIGH-TEMPERATURE PROCESSES

BACKGROUND OF THE INVENTION

The invention relates generally to heat exchangers, and more particularly to a method and apparatus for controllable heat removal from a high-temperature process in order to maintain the process temperature within predetermined limits.

In many, if not all, high-temperature processes, the process temperature is optimally kept within certain limits. In certain high-temperature processes, relatively precise temperature control is necessary. One example of such a process is the thermal decomposition and oxidation of spent potlinings, which are generated in aluminum production, as explained in U.S. Pat. No. 4,763,585, which is incorporated herein by reference. Control of process temperature is important, because if the temperature is too low, combustion is incomplete, whereas if the temperature is too high, agglomeration results, which also leads to incomplete combustion. In combustion of spent potlinings in a fluidized bed reactor, it may be desirable for the combustion temperature to be maintained within a temperature range of, for example, 1500° F. to 1550° F.

In the past, attempts have been made to enable temperature control in fluidized bed combustion of spent potlinings by the use of a water-cooled bayonet tube heat exchanger. It has been found that temperature control is difficult to achieve merely by variation of water flow rate because of the large difference between the process temperature and the boiling point of the water. The water flow rate can only be reduced to the extent that the coolant temperature remains below the boiling point, because if the coolant were heated beyond the boiling point, unstable and unpredictable internal heat transfer conditions would occur along the lengths of the heat exchanger tubes. This would result in a lack of control over the heat removal rate, and additionally would impose unacceptably great thermal stresses on the tubes.

In one known reactor, temperature control has been addressed by enabling longitudinal movement of the bayonet tubes so that the tubes may be partially withdrawn from the process to reduce heat exchange. Due to the cost and mechanical complexity associated therewith, such mechanical variation of heat exchange surface area is not an entirely acceptable solution to the problem of temperature control. Another approach would be to subject the water to extremely high pressure, but this would, of course, increase the structural and pumping requirements of the system greatly.

There remains a need for an improved method and apparatus for removing heat from high-temperature processes such as fluidized bed combustion of spent potlinings.

SUMMARY OF THE INVENTION

In accordance with the invention, a method and apparatus for removing heat from a high-temperature process are provided wherein finely atomized liquid suspended in a stream of transport gas is used as a coolant and pumped through a heat exchanger while remaining separated from the high-temperature process. The system pressure and flow rates are maintained at levels such that the temperature of the coolant exceeds the boiling point of the liquid component at the outlet of the heat exchanger. Means are provided to monitor the temperature of the process and adjust the flow rates of the liquid and/or the transport gas as necessary to maintain the process temperature at the desired level.

A principal advantage of the method of the invention is that it enables relatively large, prompt, predictable variations in heat removal rate to be achieved with relatively low variations in liquid flow rate. Thus, relatively precise control of heat removal may be maintained over a broad range of heat removal rates.

In some embodiments of the invention, the atomized liquid is water, and either air or steam is used as the transport gas. Air has an advantage in its ability to be compressed to any desired pressure using readily available commercial equipment. Steam has an advantage in that its use simplifies condenser design in a closed loop system.

The invention has particular utility in connection with fluidized bed combustion processes which are highly temperature sensitive. In one embodiment, a bayonet tube heat exchanger is employed in a fluidized bed reactor, with the bayonet tubes extending downward from the upper end of the reactor substantially vertically.

It is a general object of the invention to provide a novel and improved method and apparatus for controllably cooling a high-temperature process. Further objects and advantages of the invention are set forth hereinbelow.

DETAILED DESCRIPTION OF PREFERRED EMBODIMENTS

Figure 2:
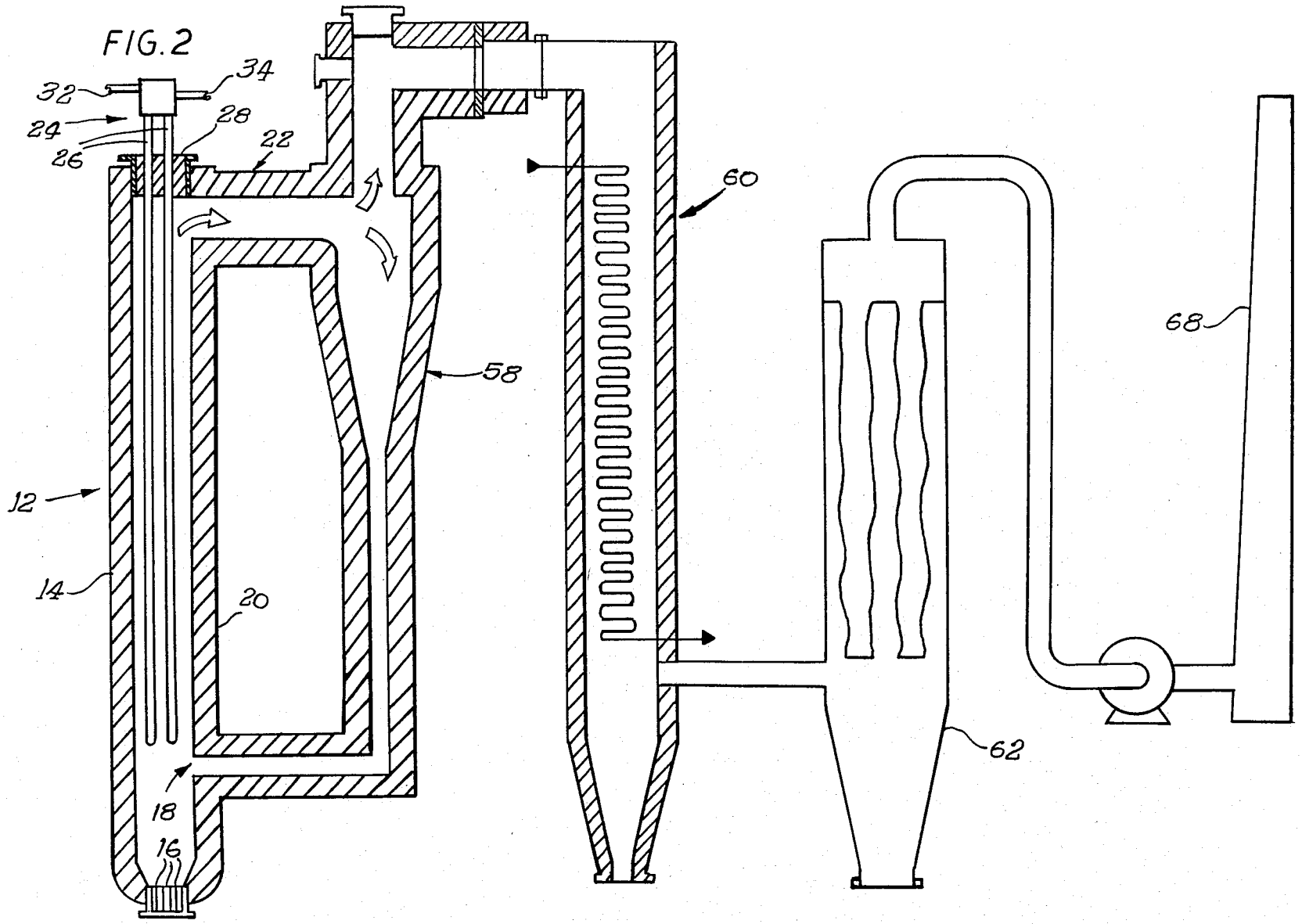
FIG. 2 is a more detailed schematic drawing of the fluidized bed reactor of FIG. I and associated equipment.

FIG. I illustrates heat exchange apparatus 10 in conjunction with a fluidized bed reactor 12. As illustrated in FIG. 2, the fluidized bed reactor 12 comprises a generally cylindrical or rectangular, vertically oriented vessel 14 having air inlet ports 16 at its lower end, and a port 18 for input of combustibles near the lower end of its sidewall 20. An exhaust port 22 is disposed near the upper end of the sidewall. During operation, solid or liquid combustible material is introduced through the combustible inlet port 18 and burned while it is carried upward by air blown up through the air inlet ports 16.

Figure 1:
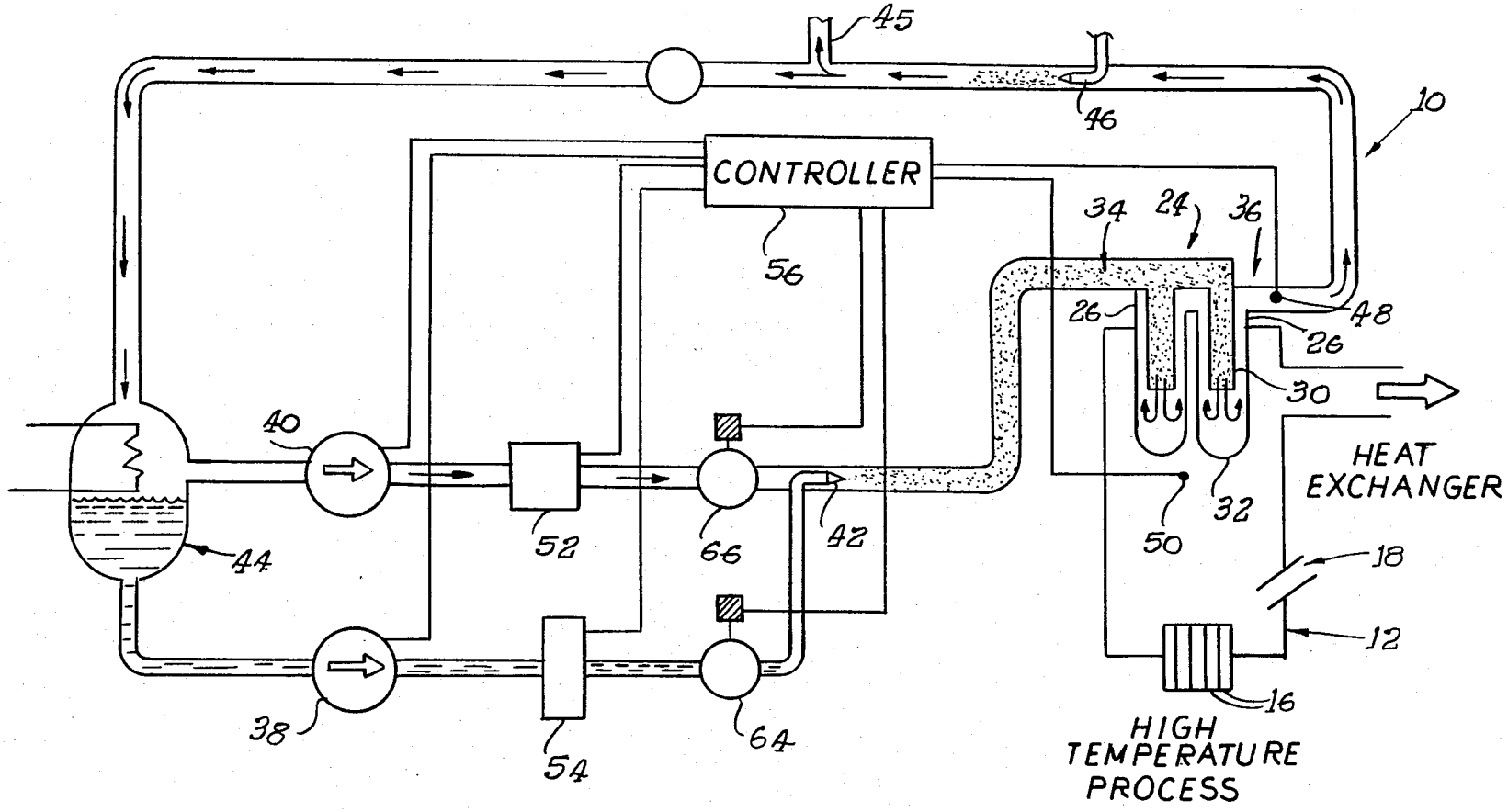
FIG. 1 is a schematic view illustrating heat exchange apparatus in accordance with a preferred embodiment of the invention, in conjunction with a fluidized bed reactor.

Heat generated by the combustion is transferred to fluid disposed within a heat exchanger 24 extending into the vessel 14. The illustrated heat exchanger 24 comprises a plurality of bayonet tubes 26 which extend vertically downward from the top wall 28 of the vessel along a major portion of the height of the vessel. The tubes 26 are preferably arranged in a circular array disposed concentrically in the vessel interior with a diameter equal to about one-half of the vessel diameter. As shown in FIG. 1, each bayonet tube comprises two separate coaxial tubes. The inner tube 30 is open-ended and the outer tube 32 is closed at its lower end. Coolant is pumped into an inlet 34 and downwardly through the inner tubes 30, and upon reaching the lower ends of the inner tubes it flows radially outward and reverses direction, flowing upward between the inner tube 30 and the outer tube 32 to an outlet 36.

In accordance with a feature of the invention, the coolant comprises a mixture of finely atomized liquid and transport gas, and the system is configured such that, at the maximum coolant flow and maximum process heat generation levels, the temperature of the coolant slightly exceeds the boiling temperature of the liquid at the outlet of the heat exchanger. This provides that the atomized liquid component of the coolant is substantially entirely vaporized in the heat exchanger, and that the resulting vapor is at least slightly superheated as it exits the heat exchanger. The liquid and gas flow rates are adjustable downwardly from their maximum levels. As they are reduced, the coolant outlet temperature increases. Maintaining coolant temperatures and pressures at these levels provides that small variations in liquid flow rate result in relatively large, prompt, predictable variations in the heat removal rate, and that the exhaust temperature provides a reliable indication of the heat removal rate. The superheating additionally enables the coolant to be pumped to a condenser without any condensation of the liquid component before the condenser. Further, the system may be configured to enable the coolant to be maintained at approximately the boiling point of the liquid throughout most of its flow through the outer portions of the bayonet tubes, which enables improved control over localized variations of process temperatures in some processes.

In accordance with a further aspect of the invention, control of the heat removal rate is provided by varying one or both of the coolant flow rate and the composition thereof. In one embodiment, the gas flow rate is normally held constant, and the liquid flow rate is varied between a maximum value and zero to provide a substantial range of heat removal rates. If necessary, reduction of heat removal rate below the rate corresponding to zero liquid flow can be achieved by reducing the gas flow from the normal constant rate to zero. In other embodiments, the gas/liquid ratio is held constant, and the total coolant flow varied between zero and a maximum value.

The liquid component of the coolant preferably comprises water. The gas is preferably air or steam.

As illustrated in FIG. 1, the apparatus of the invention may employ a closed loop system, wherein pumps 38 and 40 are provided for the liquid and gas, with the liquid being atomized and introduced into the gas by a nozzle 42 located a short distance upstream from the heat exchanger 24. Upon exiting the heat exchanger, the coolant flows to a condenser 44, where it is separated into gas and liquid components, and recycled.

Where steam is used as a transport gas, the coolant emerging from the heat exchanger will consist entirely of steam, and in such embodiments, a portion of this steam may be diverted from the cooling loop through a suitable conduit 45 and used for plant functions, such as heating and atomization of liquid fuels and sludge-like waste materials, and co-generation of electrical power. In such embodiments, a second water spray nozzle 46 may be provided between the hat exchanger 24 and conduit 45 to inject water into the exhaust steam when necessary to reduce its temperature to a desired level. Where adequate water supplies are available, the additional water spray may also provide a desirable method of reducing the condenser inlet temperature.

As noted above, the invention has particular utility in fluidized bed combustion processes which are highly temperature sensitive. One example of such a process involves the combustion of spent potlinings, where it may be desirable for the process temperature to be maintained between about 1400° F. and 1600° F., with an optimal range of about 1500° F. to 1550° F. Combustion of other materials, such as organic hazardous wastes containing oils and solvents, may require process temperatures between about 1350° F. and 1800° F., with an optimal range of, for example, about 1600° F. to 1700° F.

Control of the process temperature is achieved by selecting liquid and gas flow rates such that the desired process temperature at maximum heat removal and coolant flow rates is achieved with the coolant temperature slightly above the boiling point of the liquid component at the outlet of the heat exchanger. The outlet temperature of the coolant is determined by a temperature sensor 48, which provides an input to a controller 56. The process temperature is measured by a separate temperature sensor 50 that also provides an input to the controller. Gas and liquid flow rates are input by gauges 52 and 54 respectively. The controller makes appropriate adjustments of regulating valves 64 and 66 on the gas and liquid feed lines to adjust the coolant flow and/or composition as appropriate to maintain the process at the desired temperature.

Turning to a more detailed description of the fluidized bed reactor and related equipment as shown in FIG. 2, the vessel 14, as described above, includes an inlet for combustibles 18 near the lower end of its sidewall, and an exhaust duct 22 near the top of its sidewall. Air is blown into the reactor through inlet ports 16. After exiting through the exhaust duct, the exhaust flows into a cyclone 58 in which the exhaust is separated. Large particulate matter is carried downward and back into the reactor vessel 14, while the remainder of the particulate matter and exhaust gas travels upwardly out of the cyclone to a flue gas cooler 60, and from there to a bag house 62 where particulate material is removed. The cooled, cleaned exhaust then travels to a stack 68 for release to the atmosphere.

One example of a process embodying the invention will now be described in detail. The example involves processing a waste material with a variable heating value ranging from 1,000 to 10,000 BTU per pound at a temperature of 1600° F. The material is fed into the reactor at a controlled rate. The feed rate varies in response to various process conditions, including temperature, flue gas composition, and process upsets. Air is also blown into the reactor at a controlled rate. The maximum required heat removal rate is 5.25 million BTU per hour.

Maximum heat duty can be achieved using a coolant consisting of 4500 pounds per hour transport air and 4500 pounds per hour atomized water. The coolant at the outlet of the heat exchanger is a mixture of air and superheated steam at a temperature of 260° F. at a pressure of 1 atmosphere. Selection of a temperature of 260° F. as a coolant exhaust temperature provides the above-discussed advantages attendant to slight superheating of the liquid component of the coolant. In other embodiments, the coolant exhaust temperature might be set at other temperatures within a range of about 220° F. to 300° F.

The heat balance in the heat exchanger is approximately as follows, using specific heats of 1.0, 0.4 and 0.25 BTU/lb. °F., for liquid water, steam and air respectively. The heat of vaporization of water, $h_{vap}$, is taken as 970 BTU/lb. The input temperature of both water and air is 80° F.

| | |
|---|---|
| Air: | |
| $Q = m_A c_p \Delta T$ | |
| $= (4500)(0.25)(260-80)$ | |
| $= 202{,}500$ BTU/hr | |
| Heating of liquid water: | |
| $Q = m_W c_p \Delta T$ | |
| $= (4500)(1.0)(212-80)$ | |
| $= 594{,}000$ BTU/hr | |
| Vaporizing water: | |
| $Q = m_W h_{vap}$ | |
| $= (4500)(970)$ | |
| $= 4{,}365{,}000$ BTU/hr | |
| Heating steam: | |
| $Q = m_W c_p \Delta T$ | |
| $= (4500)(0.4)(260-212)$ | |
| $= 86{,}400$ BTU/hr | |

The total maximum heat duty is thus 5,248,000 BTU/hr.

Reduction of heat duty below the maximum may be obtained initially by reducing only water flow rate. As the water flow rate approaches zero, the coolant outlet temperature will increase to a value close to the process temperature, 1600° F., resulting in a heat removal rate of 1,710,000 BTU/hr., which is about ⅓ of the maximum heat duty. If further downward adjustment is needed, the air flow rate can then be reduced. Reduction of air flow rate to 1350 lb./hr yields a heat removal rate of 513,000 BTU/hr, Which is less than 10% of the maximum heat removal rate. Thus, a turndown of greater than 10:1 is available in the above example without varying the heat exchanger surface area within the incinerator chamber while maintaining substantial coolant flow. Of course, with suitable provision for protection of components located upstream of the heat exchanger 24, the system may be capable of operating with zero gas flow. The turndown capability of the system 10 distinguishes it from known liquid-cooled systems where some minimum coolant flow must be maintained to avoid boiling of a coolant.

Control of the flow rates may be achieved by the use of variable flow control valves 64 and 66 and/or by providing that the pumps 38 and 40 have variable output. The controller 56 receives signals from the gas and liquid flow gauges 52 and 54, and the temperature sensors 48 and 50, and compares the process and the coolant outlet temperatures with first and second reference temperatures, respectively. The reference temperature may be either a specific point or a temperature range. The controller then sends appropriate signals to the valves and/or the pumps, causing them to increase or decrease flow as appropriate.

When the process temperature exceeds the first reference temperature, the controller increases liquid flow if the gas flow rate is at its maximum, the liquid flow rate is less than its maximum, and the coolant outlet temperature is greater than the second reference temperature. The controller decreases the liquid flow rate when the process temperature is below the first reference temperature and the liquid flow rate is greater than zero.

When the liquid flow rate is at zero, the gas flow rate is changed. The controller increases the gas flow rate when the process temperature exceeds the first reference temperature and the gas flow rate is less than its maximum. The controller decreases the gas flow rate when the process temperature is less than the first reference temperature and the liquid flow rate is zero.

From the foregoing it will be appreciated that the invention provides a method and apparatus for controllable removal of heat from high-temperature processes wherein control of heat removal rates is achieved promptly, precisely and efficiently over a broad range of process conditions. The invention is not limited to the embodiments described hereinabove or to any particular embodiments. The invention is defined more particularly by the following claims.

What is claimed is:

1. A method of controllably cooling a high-temperature process comprising the steps of:

pumping a coolant comprising a mixture of gas and atomized liquid through a heat exchanger to enable heat transfer from said high-temperature process to said coolant in said heat exchanger while maintaining said coolant separate from said process;

measuring the process temperature;

comparing the temperature of said process with a reference temperature; and varying the flow rate of at least one of said liquid and said gas as necessary to maintain the actual temperature of said process close to said reference temperature while maintaining a coolant flow rate such that said atomized liquid is substantially entirely vaporized and the resulting vapor is at least slightly superheated in said heat exchanger.

2. A method in accordance with claim 1 wherein said gas and said atomized liquid are comprised of the same fluid, in different phases.

3. A method in accordance with claim 2 wherein said gas comprises steam and said liquid comprises water.

4. A method in accordance with claim 1 wherein said gas comprises air and said liquid comprises water.

5. A method in accordance with claim 4 wherein the reference temperature is between about 1350° F. and about 1800° F., and the coolant emerging from the heat exchanger is at about atmospheric pressure and is maintained at a minimum temperature of between about 220° F. and 300° F.

6. A method in accordance with claim 5 wherein said reference temperature is between about 1500° F. and about 1700° F.

7. A method in accordance with claim 1 wherein the ratio of the maximum controllable heat removal rate to the minimum controllable heat removal rate, i.e., the turndown capability, is at least about 3:1.

8. A method in accordance with claim 7 wherein the turndown capability is at least about 10:1.

9. A method of treatment of waste material comprising the steps of:

feeding said material into a fluidized bed reactor at a controlled rate and burning said material at a temperature between about 1350° F. and about 1800° F.;

pumping a coolant comprising a mixture of a gas and atomized liquid through a heat exchanger to enable heat transfer from said high-temperature process to said coolant in said heat exchanger while maintaining said coolant separate from said process, each of said liquid and said gas having a controlled flow rate;

maintaining the flow rate of said liquid between zero and a predetermined maximum, and maintaining the flow rate of said gas between zero and a predetermined maximum;

controlling said flow rates such that said atomized liquid is substantially entirely vaporized and the resulting vapor is at least slightly superheated in said heat exchanger;

measuring the process temperature and the coolant outlet temperature, said coolant outlet temperature being the temperature of coolant emerging from said heat exchanger;

comparing said process temperature with a first reference temperature;

comparing said coolant outlet temperature with a second reference temperature slightly greater than the boiling temperature of said liquid; and varying the flow rate of at least one of said liquid and said gas to maintain the process temperature close to said first reference temperature while maintaining said coolant outlet temperature above said second reference temperature by the following steps:

measuring the liquid and gas flow rates;

increasing said liquid flow rate when said process temperature exceeds said first reference temperature, said gas flow rate is at said maximum gas flow rate, said liquid flow rate is less than the maximum liquid flow rate, and the coolant outlet temperature is greater than the second reference temperature;

decreasing said liquid flow rate when said process temperature is below said first reference temperature and said liquid flow rate is greater than zero;

increasing said gas flow rate when said process temperature exceeds said first reference temperature and said gas flow rate is less than said maximum gas flow rate; and decreasing said gas flow rate when said process temperature is less than said first predetermined reference temperature and said liquid flow rate is zero.

10. A method in accordance with claim 9 wherein said gas is air and said liquid is water.

11. A method in accordance with claim 9 wherein the said waste material comprises organic hazardous waste and said first predetermined reference temperature is between about 1600° F. and about 1700° F.

12. A method in accordance with claim 9 wherein the said waste material comprises spent potlinings and said first predetermined reference temperature is between about 1500° F. and 1550° F.

13. A method in accordance with claim 12 wherein a turndown ratio of at least 10:1 is provided, and wherein variation of said liquid flow rate alone provides a turndown ratio of at least about 3:1.

14. A method in accordance with claim 11 wherein the coolant emerging from the heat exchanger is at about atmospheric pressure and the second predetermined reference temperature is about 240° F.

15. A method in accordance with claim 10 wherein the gas is steam and the liquid is water.

16. A method in accordance with claim 15 wherein the coolant emerging from the heat exchanger is at about atmospheric pressure and the second predetermined temperature is about 240° F.

17. Apparatus for cooling a high-temperature process comprising:

a heat exchanger having an inlet, an outlet, and means for carrying coolant between said inlet and said outlet to enable heat transfer from said high-temperature process to said coolant in said heat exchanger while maintaining said coolant separate from said process;

means for pumping a coolant comprising a mixture of a gas and an atomized liquid into said inlet of said heat exchanger;

means for measuring the process temperature and the coolant outlet temperature of coolant emerging from said heat exchanger;

means for comparing the temperature of said process with a first predetermined reference temperature;

means for comparing the temperature of said coolant emerging from said heat exchanger with a second predetermined reference temperature slightly greater than the boiling temperature of said liquid; and means for varying the flow rate of at least one of said liquid and said gas as necessary to maintain the actual temperature of said process close to said first reference temperature while maintaining said coolant outlet temperature above said second predetermined reference temperature so that said atomized liquid is substantially and entirely vaporized and the resulting vapor is at least slightly superheated in said heat exchanger.

18. Apparatus in accordance with claim 17 wherein said heat exchanger comprises at least one bayonet tube assembly.

19. Apparatus in accordance with claim 18 wherein said means for pumping comprises a pump for pumping said gas, and a pump and nozzle for pumping and atomizing said liquid and spraying it into said gas.

20. Apparatus for high-temperature combustion of waste materials comprising:

a fluidized bed reactor;

a heat exchanger comprising a plurality of vertically oriented bayonet tube assemblies, and means to support said bayonet tube assemblies such that they extend downwardly in substantially vertical orientations in said fluidized bed reactor, said heat exchanger having an inlet and an outlet;

means for pumping a coolant comprising a mixture of a gas and an atomized liquid into said heat exchanger to enable heat to be transferred to said coolant in said heat exchanger so that said atomized liquid is substantially entirely vaporized;

means for measuring the combustion temperature in said fluidized bed reactor outside of said heat exchanger;

means for measuring the temperature of coolant at the outlet of said heat exchanger; and means for varying the flow rate of at least one of said liquid and said gas as necessary to maintain the combustion temperature within a predetermined range while maintaining the temperature of said coolant at the outlet of said heat exchanger above the boiling temperature so that said coolant comprises a mixture of said gas and vapor which is at least slightly superheated.

* * * * *

UNITED STATES PATENT AND TRADEMARK OFFICE

CERTIFICATE OF CORRECTION

PATENT NO. : 4,883,115

DATED : November 28, 1989

INVENTOR(S) : Niles W. Johanson, James C. Saeger, and Mark L. White

It is certified that error appears in the above-identified patent and that said Letters Patent is hereby corrected as shown below:

Column 3, line 61, change "hat" to --heat--.

Column 4, line 67, after "F." delete ","(first occurrence)

Column 5, line 30, change "Which" to --which--.

Column 7, line 56, change "claim 10" to --claim 9--.

Signed and Sealed this

Twentieth Day of August, 1991

*Attest:*

*Attesting Officer*

HARRY F. MANBECK, JR.

*Commissioner of Patents and Trademarks*